United States Patent [19]

Kalnes et al.

[11] Patent Number: 4,840,721

[45] Date of Patent: Jun. 20, 1989

[54] PROCESS FOR TREATING A TEMPERATURE-SENSITIVE HYDROCARBONACEOUS STREAM CONTAINING A NON-DISTILLABLE COMPONENT TO PRODUCE A HYDROGENATED DISTILLABLE HYDROCARBONACEOUS PRODUCT

[75] Inventors: Tom N. Kalnes, La Grange; Robert B. James, Jr., Northbrook, both of Ill.

[73] Assignee: UOP, Des Plaines, Ill.

[21] Appl. No.: 169,242

[22] Filed: Mar. 16, 1988

[51] Int. Cl.[4] ..... C10G 9/16; C10G 34/00

[52] U.S. Cl. ..... 208/57; 208/81; 208/262.5; 208/84; 208/101; 585/469

[58] Field of Search ..... 208/51, 50, 57, 81, 208/84, 89, 185, 101, 139, 226, 204, 262, 208 R; 585/469

[56] References Cited

U.S. PATENT DOCUMENTS

| | | | |
|---|---|---|---|
| 3,738,931 | 6/1973 | Frankovich et al. | 208/67 |
| 3,992,285 | 11/1976 | Hutchings | 208/208 R |
| 4,127,393 | 11/1978 | Timmins et al. | 208/107 X |
| 4,469,590 | 9/1984 | Schucker et al. | 208/143 |
| 4,481,101 | 11/1984 | Yan | 208/208 R |

*Primary Examiner*—Glenn Caldarola

*Attorney, Agent, or Firm*—Thomas K. McBride; John G. Tolomei; John G. Cutts, Jr.

[57] ABSTRACT

A process for treating a temperature-sensitive hydrocarbonaceous stream containing a non-distillable component to produce a hydrogenated distillable hydrocarbonaceous product and a heavy product comprising the non-distillable component while minimizing thermal degradation of the hydrocarbonaceous stream which process comprises the steps of: (a) contacting the hydrocarbonaceous stream with a hot first hydrogen-rich gaseous stream having a temperature greater than the hydrocarbonaceous stream in a first flash zone at flash conditions including a first pressure thereby increasing the temperature of the hydrocarbonaceous stream and vaporizing at least a portion thereof to provide a first hydrocarbonaceous vapor stream comprising hydrogen and a first heavy product stream comprising the non-distillable component; (b) contacting the first heavy product stream comprising the non-distillable component with a hot second hydrogen-rich gaseous stream in a second flash zone at flash conditions including a second pressure which is less than the first pressure of step (a) thereby vaporizing at least a portion thereof to provide a second hydrocarbonaceous vapor stream comprising hydrogen and a second heavy product stream comprising the non-distillable component; (c) condensing at least a portion of the second hydrocarbonaceous vapor stream to provide a first liquid stream comprising distillable hydrocarbonaceous compounds; (d) contacting the first hydrocarbonaceous vapor stream comprising hydrogen from step (a) and the first liquid stream comprising distillable hydrocarbonaceous compounds from step (c) with a hydrogenation catalyst in a hydrogenation reaction zone at hydrogenation conditions to increase the hydrogen content of the hydrocarbonaceous compounds introduced into the hydrogenation reaction zone; (e) condensing at least a portion of the resulting effluent from the hydrogenation reaction zone to provide a third hydrogen-rich gaseous stream and a liquid stream comprising hydrogenated distillable hydrocarbonaceous compounds; and (f) recovering a hydrogenated distillable hydrocarbonaceous product from the liquid stream comprising hydrogenated distillable hydrocarbonaceous compounds.

41 Claims, 1 Drawing Sheet

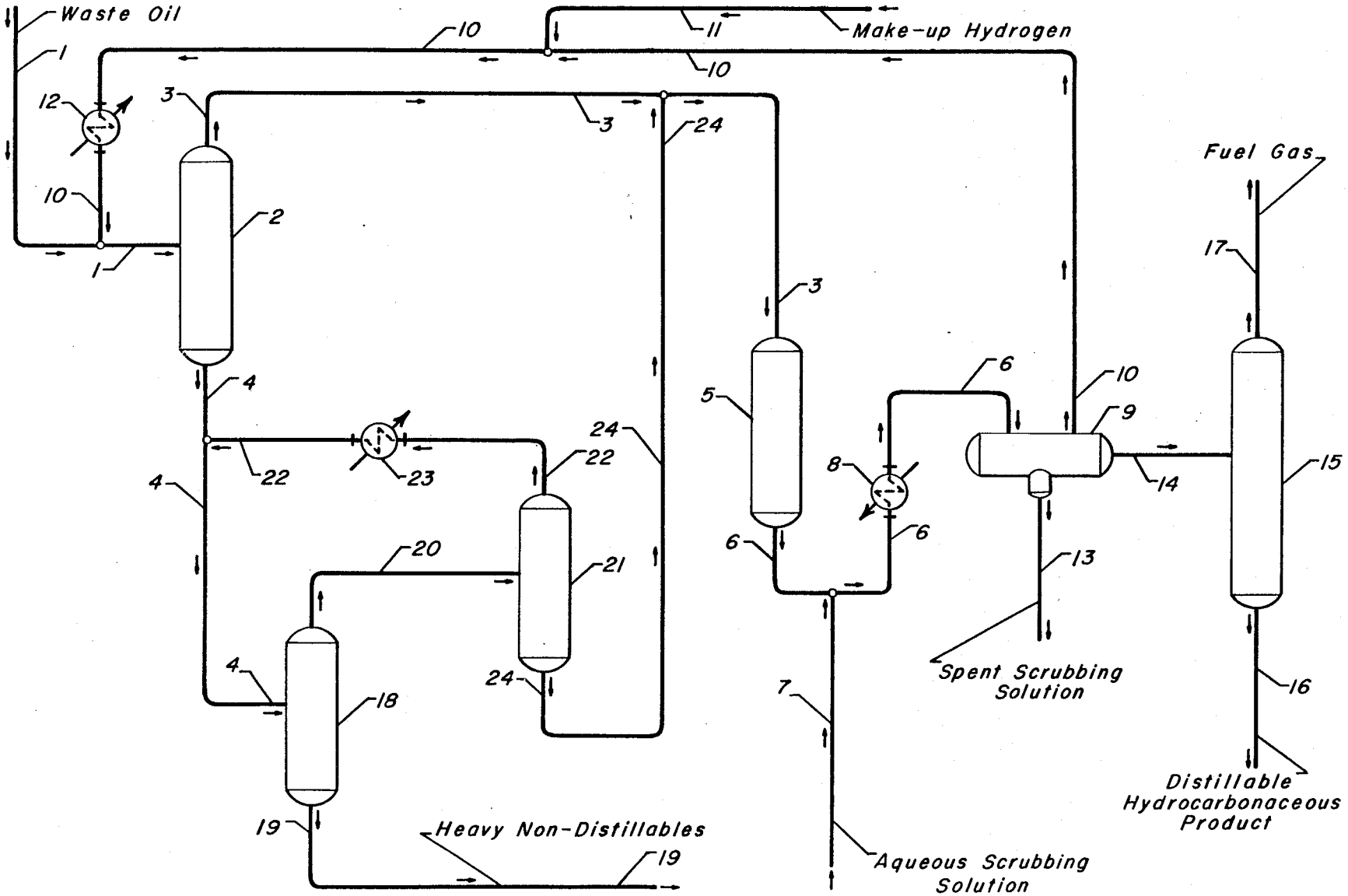
Fuel Gas
Distillable Hydrocarbonaceous Product
Spent Scrubbing Solution
Aqueous Scrubbing Solution
Make-up Hydrogen
Heavy Non-Distillables
Waste Oil

PROCESS FOR TREATING A TEMPERATURE-SENSITIVE HYDROCARBONACEOUS STREAM CONTAINING A NON-DISTILLABLE COMPONENT TO PRODUCE A HYDROGENATED DISTILLABLE HYDROCARBONACEOUS PRODUCT

BACKGROUND OF THE INVENTION

The field of art to which this invention pertains is the production of a hydrogenated distillable hydrocarbonaceous product from a temperature-sensitive hydrocarbonaceous stream containing a non-distillable component. More specifically, the invention relates to a process for treating a temperature-sensitive hydrocarbonaceous stream containing a non-distillable component to produce a hydrogenated distillable hydrocarbonaceous product and a heavy product comprising the non-distillable component while minimizing thermal degradation of the hydrocarbonaceous stream which process comprises the steps of: (a) contacting the hydrocarbonaceous stream with a hot first hydrogen-rich gaseous stream having a temperature greater than the hydrocarbonaceous stream in a first flash zone at flash conditions including a first pressure thereby increasing the temperature of the hydrocarbonaceous stream and vaporizing at least a portion thereof to provide a first hydrocarbonaceous vapor stream comprising hydrogen and a first heavy product stream comprising the non-distillable component; (b) contacting the first heavy product stream comprising the non-distillable component with a hot second hydrogen-rich gaseous stream in a second flash zone at flash conditions including a second pressure which is less than the first pressure of step (a) thereby vaporizing at least a portion thereof to provide a second hydrocarbonaceous vapor stream comprising hydrogen and a second heavy product stream comprising the non-distillable component; (c) condensing at least a portion of the second hydrocarbonaceous vapor stream to provide a first liquid stream comprising distillable hydrocarbonaceous compounds; (d) contacting the first hydrocarbonaceous vapor stream comprising hydrogen from step (a) and the first liquid stream comprising distillable hydrocarbonaceous compounds from step (c) with a hydrogenation catalyst in a hydrogenation reaction zone at hydrogenation conditions to increase the hydrogen content of the hydrocarbonaceous compounds introduced into the hydrogenation reaction zone; (e) condensing at least a portion of the resulting effluent from the hydrogenation reaction zone to provide a third hydrogen-rich gaseous stream and a liquid stream comprising hydrogenated distillable hydrocarbonaceous compounds; and (f) recovering a hydrogenated distillable hydrocarbonaceous product from the liquid stream comprising hydrogenated distillable hydrocarbonaceous compounds.

INFORMATION DISCLOSURE

In U.S. Pat. No. 3,992,285 (Hutchings), a process is disclosed for the desulfurization of a hydrocarbonaceous black oil containing sulfur and asphaltic material which comprises preheating the oil by indirect heat exchange to a temperature not in excess of about 550° F., commingling the preheated oil with a steam-containing gas to raise the temperature of the oil to a desulfurization temperature of about 600° F. to about 800° F.

and contacting the thus heated oil at hydrocarbon conversion conditions with a desulfurization catalyst.

BRIEF SUMMARY OF THE INVENTION

The invention provides an improved process for the production of a hydrogenated distillable hydrocarbonaceous product from a temperature-sensitive hydrocarbonaceous stream containing a non-distillable component by means of a two-stage contacting of the hydrocarbonaceous feed stream with a first hot hydrogen-rich gaseous stream to increase the temperature of the feed stream to vaporize a first portion of the distillable hydrocarbonaceous compounds in a first stage and to subsequently contact the previously unvaporized feed stream from the first stage with a second hot hydrogen-rich gaseous stream to vaporize a second portion of the distillable hydrocarbonaceous compounds in a second stage having a pressure less than the pressure in the first stage. The resulting combined first and second portion of the distillable hydrocarbonaceous compounds is immediately hydrogenated in an integrated hydrogenation zone. Important elements of the improved process are the relatively short time that the feed stream is maintained at elevated temperature, the avoidance of heating the feed stream via indirect heat exchange to preclude the coke formation that could otherwise occur and the minimization of utility costs due to the integration of the hydrogenation zone.

One embodiment of the invention may be characterized as a process for treating a temperature-sensitive hydrocarbonaceous stream containing a non-distillable component to produce a hydrogenated distillable hydrocarbonaceous product and a heavy product comprising the non-distillable component while minimizing thermal degradation of the hydrocarbonaceous stream which process comprises the steps of: (a) contacting the hydrocarbonaceous stream with a hot first hydrogen-rich gaseous stream having a temperature greater than the hydrocarbonaceous stream in a first flash zone at flash conditions including a first pressure thereby increasing the temperature of the hydrocarbonaceous stream and vaporizing at least a portion thereof to provide a first hydrocarbonaceous vapor stream comprising hydrogen and a first heavy product stream comprising the non-distillable component; (b) contacting the first heavy product stream comprising the non-distillable component with a hot second hydrogen-rich gaseous stream in a second flash zone at flash conditions including a second pressure which is less than the first pressure of step (a) thereby vaporizing at least a portion thereof to provide a second hydrocarbonaceous vapor stream comprising hydrogen and a second heavy product stream comprising the non-distillable component; (c) condensing at least a portion of the second hydrocarbonaceous vapor stream to provide a first liquid stream comprising distillable hydrocarbonaceous compounds; (d) contacting the first hydrocarbonaceous vapor stream comprising hydrogen from step (a) and the first liquid stream comprising distillable hydrocarbonaceous compounds from step (c) with a hydrogenation catalyst in a hydrogenation reaction zone at hydrogenation conditions to increase the hydrogen content of the hydrocarbonaceous compounds introduced into the hydrogenation reaction zone; (e) condensing at least a portion of the resulting effluent from the hydrogenation reaction zone to provide a third hydrogen-rich gaseous stream and a liquid stream comprising hydrogenated distillable hydrocarbonaceous compounds; and (f) recovering a hydrogenated distillable hydrocarbonaceous product from the liquid stream comprising hydrogenated distillable hydrocarbonaceous compounds.

Another embodiment of the invention may be characterized as a process for treating a temperature-sensitive hydrocarbonaceous stream containing a non-distillable component to produce a hydrogenated distillable hydrocarbonaceous product and a heavy product comprising the non-distillable component while minimizing thermal degradation of the hydrocarbonaceous stream which process comprises the steps of: (a) contacting the hydrocarbonaceous stream with a hot first hydrogen-rich gaseous stream having a temperature greater than the hydrocarbonaceous stream in a first flash zone at flash conditions thereby increasing the temperature of the hydrocarbonaceous stream and vaporizing at least a portion thereof to provide a first hydrocarbonaceous vapor stream comprising hydrogen and a first heavy product stream comprising the non-distillable component; (b) contacting the first heavy product stream comprising the non-distillable component with a hot second hydrogen-rich gaseous stream in a second flash zone at flash conditions including a second pressure which is less than the first pressure of step (a) thereby vaporizing at least a portion thereof to provide a second hydrocarbonaceous vapor stream comprising hydrogen and a second heavy product stream comprising the non-distillable component; (c) condensing at least a portion of the second hydrocarbonaceous vapor stream to provide a first liquid stream comprising distillable hydrocarbonaceous compounds; (d) contacting the first hydrocarbonaceous vapor stream comprising hydrogen from step (a) and the first liquid stream comprising distillable hydrocarbonaceous compounds from step (c) with a hydrogenation catalyst in a hydrogenation reaction zone at hydrogenation conditions to increase the hydrogen content of the hydrocarbonaceous compounds introduced into the hydrogenation reaction zone; (e) condensing at least a portion of the resulting effluent from the hydrogenation reaction zone to provide a third hydrogen-rich gaseous stream and a first liquid stream comprising hydrogenated distillable hydrocarbonaceous compounds; and (f) separating the first liquid stream comprising hydrogenated distillable hydrocarbonaceous compounds to provide a third hydrocarbonaceous vapor stream comprising normally gaseous hydrocarbons and a normally liquid hydrogenated distillable hydrocarbonaceous product.

Yet another embodiment of the invention may be characterized as a process for treating a temperature-sensitive hydrocarbonaceous stream containing a non-distillable component to produce a hydrogenated distillable hydrocarbonaceous product and a heavy product comprising the non-distillable component while minimizing thermal degradation of the hydrocarbonaceous stream which process comprises the steps of: (a) contacting the hydrocarbonaceous stream with a hot first hydrogen-rich gaseous stream having a temperature greater than the hydrocarbonaceous stream in a first flash zone at flash conditions including a first pressure thereby increasing the temperature of the hydrocarbonaceous stream and vaporizing at least a portion thereof to provide a first hydrocarbonaceous vapor stream comprising hydrogen and a first heavy product stream comprising the non-distillable component; (b) contacting the first heavy product stream comprising the non-distillable component with a hot second hydrogen-rich gaseous stream in a second flash zone at flash conditions including a second pressure which is less than the first pressure of step (a) thereby vaporizing at least a portion thereof to provide a second hydrocarbonaceous vapor stream comprising hydrogen and a second heavy product stream comprising the non-distillable component; (c) condensing at least a portion of the second hydrocarbonaceous vapor stream to provide a first liquid stream comprising distillable hydrocarbonaceous compounds; (d) contacting the first hydrocarbonaceous vapor stream comprising hydrogen from step (a) and the first liquid stream comprising distillable hydrocarbonaceous compounds from step (c) with a hydrogenation catalyst in a hydrogenation zone at hydrogenation conditions to simultaneously increase the hydrogen content of the hydrocarbonaceous compounds introduced into the hydrogenation reaction zone and to generated at least one water-soluble inorganic compound produced from the reaction of the hydrocarbonaceous compounds introduced into the hydrogenation reaction zone and the hydrogen; (e) contacting the resulting effluent from the hydrogenation zone containing hydrogenated hydrocarbonaceous compounds and at least one water-soluble inorganic compound with a fresh aqueous scrubbing solution; (f) introducing a resulting admixture of the effluent from the hydrogenation zone and the aqueous scrubbing solution into a separation zone to provide a third hydrogen-rich gaseous stream, a first liquid stream comprising hydrogenated distillable hydrocarbonaceous compounds and a spent aqueous scrubbing solution containing at least a portion of the water-soluble inorganic compound; and (g) separating the first liquid stream comprising hydrogenated distillable hydrocarbonaceous compounds to provide a third hydrocarbonaceous vapor stream comprising normally gaseous hydrocarbons and a normally liquid hydrogenated distillable hydrocarbonaceous product.

Other embodiments of the present invention encompass further details such as preferred feedstocks, hydrogenation catalysts, aqueous scrubbing solutions and operating conditions, all of which are hereinafter disclosed in the following discussion of each of these facets of the invention.

BRIEF DESCRIPTION OF THE DRAWING

The drawing is a simplified process flow diagram of a preferred embodiment of the present invention.

DETAILED DESCRIPTION OF THE INVENTION

There is a steadily increasing demand for technology which is capable of treating a temperature-sensitive hydrocarbonaceous stream containing a non-distillable component to produce a hydrogenated distillable hydrocarbonaceous product and a heavy non-distillable product while minimizing thermal degradation of the hydrocarbonaceous feed stream. Such treatment has always been in demand for the preparation and production of various hydrocarbonaceous products but with the increased environmental emphasis for the treatment and recycle of waste hydrocarbonaceous products there is an increased need for improved processes to separate heavy non-distillable components from a distillable hydrocarbonaceous product which may then be hydrogenated. For example, during the disposal or recycle of potentially environmentally harmful hydrocarbonaceous waste streams, an important step in the total solution to the problem is the pretreatment or conditioning of a hydrocarbonaceous stream which facilitates the ultimate resolution to provide product streams which may subsequently be handled in an environmentally acceptable manner. Therefore, those skilled in the art have sought to find feasible techniques to remove heavy non-distillable components from a temperature-sensitive hydrocarbonaceous stream to provide a distillable hydrocarbonaceous product which may then be hydrogenated. Previous techniques which have been employed include filtration, vacuum wiped film evaporation, centrifugation, and vacuum distillation.

In the case where it is desirable to recycle waste lubricating oils which are considered to be temperature-sensitive and containing a non-distillable component special procedures are often required. The Occupational Safety and Health Administration (OSHA), a branch of the United States Government, has become involved with regulating the recycling of waste lubricating oils and considers that "mildly" hydrotreated oils to be carcinogens. OSHA considers "mild hydrotreating" as hydrotreating which is conducted at a reactor pressure of 800 psig (5516 kPa gauge) or less at reactor temperatures up to 800° F. (426° C.) without regard for the original feed quality, product quality or other processing parameters. This regulatory action by OSHA has caused both refining and rerefining operators to either install higher pressure hydrotreaters, i.e., greater than 800 psig (5516 kPa gauge) or to label their product as carcinogenic. It is an understatement to say that practically no one wishes to attempt to sell a product which must be labelled as carcinogenic.

In previous hydrogenating processes utilized to upgrade temperature-sensitive hydrocarbonaceous streams containing a non-distillable component where the feed is separated at hydrotreating pressures to produce a distillable fraction which is immediately introduced into a hydrotreating zone which is operated at a pressure greater than about 800 psig (5516 kPa gauge), the stripping or flashing of the temperature-sensitive hydrocarbonaceous stream to recover heavy distillable hydrocarbonaceous compounds is less effective and therefore incomplete at the higher operating pressures dictated by the OSHA regulations.

The present invention provides an improved integrated process for the removal of heavy non-distillable components from a temperature-sensitive hydrocarbonaceous stream and the subsequent hydrogenation of the distillable hydrocarbonaceous stream. A wide variety of temperature-sensitive hydrocarbonaceous streams are to be candidates for feed streams in accordance with the process of the present invention. Examples of hydrocarbonaceous streams which are suitable for treatment by the process of the present invention are dielectric fluids, hydraulic fluids, heat transfer fluids, used lubricating oil, used cutting oils, used solvents, still bottoms from solvent recycle operations, coal tars, atmospheric residuum, oils contaminated with polychlorinated biphenyls (PCB), halogenated wastes and other hydrocarbonaceous industrial waste. Many of these hydrocarbonaceous streams may contain non-distillable components which include, for example, organometallic compounds, inorganic metallic compounds, finely divided particulate matter and non-distillable hydrocarbonaceous compounds. The present invention is particularly advantageous when the non-distillable components comprise sub-micron particulate matter and the conventional techniques of filtration or centrifugation tend to be highly ineffective.

The present invention is also particularly advantageous when circumstances dictate that a relatively high pressure hydrotreater be employed and the hydrocarbonaceous feedstock cannot be adequately separated in an integrated, single stage separation zone.

The presence of a non-distillable component including finely divided particulate matter in a hydrocarbonaceous feed to a hydrogenation zone greatly increases the difficulty of the hydrogenation. A non-distillable component tends (1) to foul the hot heat exchange surfaces which are used to heat the feed to hydrogenation conditions, (2) to form coke or in some other manner deactivate the hydrogenation catalyst thereby shortening its active life and (3) to otherwise hinder a smooth and facile hydrogenation operation. Particulate matter in a feed stream tends to deposit within the hydrogenation zone and to plug a fixed hydrogenation catalyst bed thereby abbreviating the time on stream.

Once the temperature-sensitive hydrocarbonaceous feed stream is separated into distillable hydrocarbonaceous streams and a heavy non-distillable product, the resulting distillable hydrocarbonaceous streams are introduced into a hydrogenation zone. If the feed stream contains metallic compounds such as those that contain metals such as zinc, copper, iron, barium, phosphorus, magnesium, aluminum, lead, mercury, cadmium, cobalt, arsenic, vanadium, chromium, and nickel, these compounds will be isolated in the relatively small volume of recovered non-distillable product which may then be treated for metals recovery or otherwise disposed of as desired. In the event that the feed stream contains distillable hydrocarbonaceous compounds which include sulfur, oxygen, nitrogen, metal or halogen components, the resulting recovered distillable hydrocarbonaceous streams are hydrogenated to remove or convert such components as desired. In a preferred embodiment of the present invention, the hydrogenation of the resulting distillable hydrocarbonaceous stream from the first flash zone is preferably conducted immediately without intermediate separation or condensation. The advantages of the integrated process of the present invention will be readily apparent to those skilled in the art and include the economy of greatly reduced utility costs.

In accordance with the subject invention, a temperature-sensitive hydrocarbonaceous stream containing a non-distillable component is contacted with a first hot hydrogen-rich gaseous stream having a temperature greater than the hydrocarbonaceous stream in a first flash zone at flash conditions thereby increasing the temperature of the hydrocarbonaceous stream and vaporizing a first portion thereof to provide a first hydrocarbonaceous vapor stream comprising hydrogen and a first heavy stream comprising the non-distillable component. The first heavy stream comprising the non-distillable component is subsequently contacted with a second hot hydrogen-rich gaseous stream in a second flash zone at flash conditions which include a pressure less than the pressure of the first flash zone to provide a second hydrocarbonaceous vapor stream comprising hydrogen and a second heavy stream comprising the non-distillable component. The hot hydrogen-rich gaseous streams preferably comprise more than about 70 mole % hydrogen and more preferably more than about 90 mole % hydrogen. The hot hydrogen-rich gaseous streams are multi-functional and serve as (1) a heat source used to directly heat the hydrocarbonaceous feed stream to preclude the coke formation that could otherwise occur when using an indirect heating apparatus such as a heater or heat-exchanger, (2) a diluent to reduce the partial pressure and residence time of the hydrocarbonaceous compounds during vaporization in the flash zone, (3) a possible reactant to minimize the formation of hydrocarbonaceous polymers at elevated temperatures, (4) a stripping medium and (5) at least a portion of the hydrogen required in the hydrogenation reaction zone. In accordance with the subject invention, the temperature-sensitive hydrocarbonaceous feed stream is preferably maintained at a temperature less than about 580° F. (304° C.) and more preferably less than about 482° F. (250° C.) before being introduced into the first flash zone in order to prevent or minimize the thermal degradation of the feed stream. Depending upon the characteristics and composition of the hydrocarbonaceous feed stream, the hot hydrogen-rich gaseous stream is introduced into the first flash zone at a temperature greater than the hydrocarbonaceous feed stream to the first flash zone and preferably at a temperature from about 200° F. (93° C.) to about 1200° F. (649° C.). The hot hydrogen-rich gaseous stream introduced into the second flash zone may possess a temperature which is equal to, less than, or greater than the hydrocarbonaceous feed stream introduced into the second flash zone and is preferably at a temperature from about 200° F. (93° C.) to about 1200° F. (649° C.).

During the contacting, the flash zones are preferably maintained at flash conditions which include a temperature from about 150° F. (65° C.) to about 860° F. (460° C.), a pressure from about atmospheric to about 2000 psig (13788 kPa gauge), a hydrogen circulation rate of about 1000 SCFB (168 normal $m^3/m^3$) to about 30,000 SCFB (5056 normal $m^3/m^3$) based on the temperature-sensitive hydrocarbonaceous feed stream entering a flash zone and an average residence time of the hydrogen-containing, hydrocarbonaceous vapor stream in a flash zone from about 0.1 seconds to about 50 seconds. A more preferred average residence time of the hydrogen-containing, hydrocarbonaceous vapor stream in a flash zone is from about 1 second to about 10 seconds.

Although preferred operating pressures in both the first and second flash zones range from about atmospheric to about 2000 psig (13,788 kPa gauge), it is essential for the intended performance of the present invention that the operating pressure in the second flash zone be maintained at a pressure less than the operating pressure of the first flash zone. It is furthermore preferred that the first flash zone be maintained at a pressure greater than about 800 psig (5516 kPa gauge) in order to provide a hydrocarbonaceous vapor stream comprising hydrogen which may be directly introduced without separation thereof into a hydrogenation reaction zone which is nominally operated at a pressure of 800 psig (5516 kPa gauge) or above. The operation of the second flash zone at a pressure less than the pressure of the first flash zone permits the recovery of additional amounts of distillable hydrocarbonaceous compounds in order to subsequently provide a maximized amount of hydrogenated distillable hydrocarbonaceous product.

The resulting second hydrocarbonaceous vapor stream comprising hydrogen is partially condensed to provide a hydrogen-rich gaseous stream which may be recycled to the second flash zone if desired and a liquid stream comprising distillable hydrocarbonaceous compounds which is introduced into the hydrogenation reaction zone. Since the liquid stream comprising distillable hydrocarbonaceous compounds is necessarily at a pressure which is less than the pressure of the hydrogenation reaction zone, this liquid stream is preferably pumped into the hydrogenation reaction zone. The pressure of the first flash zone is preferably coordinated with the pressure of the hydrogenation reaction zone so that the hydrocarbonaceous vapor stream comprising hydrogen from the first flash zone flows without intermediate separation and pumping into the hydrogenation reaction zone.

Prior to partial condensation of the second hydrocarbonaceous vapor stream comprising hydrogen, it may be preferable, depending upon the composition of the fresh feedstock, to contact this vapor stream with a guard bed reaction zone to ensure that certain trace contaminants are prevented from ultimately being carried over into the catalytic hydrogenation zone. The contaminants which are primarily contemplated for removal in the guard bed are organometallic compounds and finely divided particulate matter. The guard bed is preferably a fixed bed zone containing high surface area adsorbent or catalyst which is designed to effectively remove the hereinabove mentioned trace contaminants and is generally operated at conditions similar to those maintained in the hydrogenation reaction zone.

The resulting heavy non-distillable portion of the feed stream is removed from the bottom of the second flash zone as required to yield a heavy non-distillable product. The heavy non-distillable product may contain a relatively small amount of distillable components but since essentially all of non-distillable components contained in the hydrocarbonaceous feed stream are recovered in this product stream, the term "heavy non-distillable product" is nevertheless used for the convenient description of this product stream. The heavy non-distillable product preferably contains a distillable component of less than about 10 weight percent and more preferably less than about 5 weight percent. Under certain circumstances with a feed stream not having an appreciable amount of liquid non-distillable components, it is contemplated that an additional liquid may be utilized to flush the heavy non-distillables from the second flash zone. An example of this situation is when the hydrocarbonaceous feed stream comprises a very high percentage of distillable hydrocarbonaceous compounds and relatively small quantities of finely divided particulate matter (solid) and essentially no liquid non-distillable component for use as a carrier for the solids. Such a flush liquid may, for example, be a high boiling range vacuum gas oil having a boiling range from about 700° F. (371° C.) to about 1000° F. (538° C.) or a vacuum tower bottoms stream boiling at a temperature greater than about 1000° F. (538° C.). The selection of a flush liquid depends upon the composition of the hydrocarbonaceous feed stream and the prevailing flash conditions in the flash separator, and the volume of the flush liquid is preferably limited to that required for removal of the heavy non-distillable component.

The resulting hydrogen-containing, hydrocarbonaceous vapor stream is removed from the first flash zone and is introduced into a catalytic hydrogenation zone containing hydrogenation catalyst and maintained at hydrogenation conditions. The liquid stream comprising distillable hydrocarbonaceous compounds which is derived from the second flash zone is appropriately heated and also introduced into the catalytic hydrogenation zone. The catalytic hydrogenation zone may contain a fixed, ebullated or fluidized catalyst bed. This reaction zone is preferably maintained under an imposed pressure from about atmospheric (0 kPa gauge) to about 2000 psig (13790 kPa gauge) and more preferably under a pressure from about 100 psig (689.5 kPa gauge) to about 1800 psig (12411 kPa gauge). Suitably, such reaction is conducted with a maximum catalyst bed temperature in the range of about 122° F. (50° C.) to about 850° F. (454° C.) selected to perform the desired hydrogenation conversion to reduce or eliminate the undesirable characteristics or components of the hydrocarbonaceous vapor stream. In accordance with the present invention, it is contemplated that the desired hydrogenation conversion includes, for example, dehalogenation, desulfurization, denitrification, olefin saturation, oxygenate conversion and hydrocracking. Further preferred operating conditions include liquid hourly space velocities in the range from about 0.05 $hr^{-1}$ to about 20 $hr^{-1}$ and hydrogen circulation rates from about 200 standard cubic feet per barrel (SCFB) (33.71 normal $m^3/m^3$) to about 50,000 SCFB (8427 normal $m^3/m^3$), preferably from about 300 SCFB (50.6 normal $m^3/m^3$) to about 20,000 SCFB (3371 normal $m^3/m^3$).

In the event that the temperature of the first hydrogen-containing, hydrocarbonaceous stream which is removed from the first flash zone is not deemed to be exactly the temperature selected to operate the catalytic hydrogenation zone, we contemplate that the temperature of the first hydrogen-containing, hydrocarbonaceous stream may be adjusted either upward or downward in order to achieve the desired temperature in the catalytic hydrogenation zone. Such a temperature adjustment may be accomplished, for example, by the addition of either cold or hot hydrogen.

The preferred catalytic composite disposed within the hereinabove described hydrogenation zone can be characterized as containing a metallic component having hydrogenation activity, which component is combined with a suitable refractory carrier material of either synthetic or natural origin. The precise composition and method of manufacturing the carrier material is not considered essential to the present invention. Preferred carrier materials are alumina, silica, carbon and mixtures thereof. Suitable metallic components having hydrogenation activity are those selected from the group comprising the metals of Groups VI-B and VIII of the Periodic Table, as set forth in the *Periodic Table of the Elements,* E. H. Sargent and Company, 1964. Thus, the catalytic composites may comprise one or more metallic components from the group of molybdenum, tungsten, chromium, iron, cobalt, nickel, platinum, palladium, iridium, osmium, rhodium, ruthenium, and mixtures thereof. The concentration of the catalytically active metallic component, or components, is primarily dependent upon a particular metal as well as the physical and/or chemical characteristics of the particular hydrocarbon feedstock. For example, the metallic components of Group VI-B are generally present in an amount within the range of from about 1 to about 20 weight percent, the iron-group metals in an amount within the range of about 0.2 to about 10 weight percent, whereas the noble metals of Group VIII are preferably present in an amount within the range of from about 0.1 to about 5 weight percent, all of which are calculated as if these components existed within the catalytic composite in the elemental state. In addition, any catalyst employed commercially for hydrogenating middle distillate hydrocarbonaceous compounds to remove nitrogen and sulfur may function effectively in the hydrogenation zone of the present invention. It is further contemplated that hydrogenation catalytic composites may comprise one or more of the following components: cesium, francium, lithium, potassium, rubidium, sodium, copper, gold, silver, cadmium, mercury and zinc.

The hydrocarbonaceous effluent from the hydrogenation zone is preferably contacted with an aqueous scrubbing solution and the admixture is admitted to a separation zone in order to separate a spent aqueous stream, a hydrogenated hydrocarbonaceous liquid phase and a hydrogen-rich gaseous phase. The contact of the hydrocarbonaceous effluent from the hydrogenation zone with the aqueous scrubbing solution may be performed in any convenient manner and is preferably conducted by co-current, in-line mixing which may be promoted by inherent turbulence, mixing orifices or any other suitable mixing means. The aqueous scrubbing solution is preferably introduced in an amount from about 1 to about 100 volume percent based on the hydrocarbonaceous effluent from the hydrogenation zone. The aqueous scrubbing solution is selected depending on the characteristics of the hydrocarbonaceous feed stream introduced into the hydrogenation zone. For example, if the hydrocarbonaceous feed stream to the hydrogenation zone comprises halogenated compounds, the aqueous scrubbing solution preferably contains a basic compound such as calcium hydroxide, potassium hydroxide or sodium hydroxide in order to neutralize the acid such as hydrogen chloride, hydrogen bromide and hydrogen fluoride, for example, which is formed during the hydrogenation of the halogen compounds. In the event that the hydrocarbonaceous feed stream contains only sulfur and nitrogen compounds, water may be a suitable aqueous scrubbing solution to dissolve the resulting hydrogen sulfide and ammonia. The resulting hydrogenated hydrocarbonaceous liquid phase is recovered and the hydrogen-rich gaseous phase may be recycled to the hydrogenation zone if desired.

The resulting hydrogenated hydrocarbonaceous liquid phase is preferably recovered from the hydrogen-rich gaseous phase in a separation zone which is maintained at essentially the same pressure as the hydrogenation reaction zone and as a consequence contains dissolved hydrogen and low molecular weight normally gaseous hydrocarbons if present. In accordance with the present invention, it is preferred that the hydrogenated hydrocarbonaceous liquid phase comprising the hereinabove mentioned gases be stabilized in a convenient manner, such as, for example, by stripping or flashing to remove the normally gaseous components to provide a stable hydrogenated distillable hydrocarbonaceous product.

In the drawing, the process of the present invention is illustrated by means of a simplified flow diagram in which such details as pumps, instrumentation, heat-exchange and heat-recovery circuits, compressors and similar hardware have been deleted as being non-essential to an understanding of the techniques involved. The use of such miscellaneous appurtenances are well within the purview of one skilled in the art.

With reference now to the drawing, a liquid hydrocarbonaceous feed stream having a non-distillable component is introduced into the process via conduit 1 and is contacted with a hot gaseous hydrogen-rich recycle stream which is provided via conduit 10 and hereinafter described. The liquid hydrocarbonaceous feed stream and the hot hydrogen-rich recycle stream are intimately contacted in hot hydrogen/separator 2. A hydrocarbonaceous vapor stream comprising hydrogen is removed from hot hydrogen/separator 2 via conduit 3 and introduced into hydrogenation reaction zone 5 without intermediate separation thereof. A heavy non-distillable stream comprising at least a portion of the distillable hydrocarbonaceous compounds is removed from the bottom of hot hydrogen/separator 2 via conduit 4 and is contacted with a hot gaseous hydrogen-rich recycle stream which is provided via conduit 22 and hereinafter described. The heavy liquid hydrocarbonaceous feed stream and the hot hydrogen-rich recycle stream are intimately contacted in hot hydrogen/separator 18 after being introduced via conduit 4. A hydrocarbonaceous vapor stream comprising hydrogen is removed from hot hydrogen/separator 18 via conduit 20 and introduced into separation zone 21 after partial condensation which is not illustrated in the drawing. A hydrogen-rich gaseous stream is removed from separation zone 21 via conduit 22, heated to a suitable temperature in heat exchanger 23 and utilized to contact the heavy hydrocarbonaceous stream as hereinabove described. A distillable hydrocarbonaceous stream is recovered from separation zone 21 via conduit 24 and is introduced into hydrogenation reaction zone 5 via conduits 24 and 3. A heavy non-distillable stream is removed from the bottom of hot hydrogen/separator 18 via conduit 19 and recovered. The resulting hydrogenated hydrocarbonaceous stream is removed from hydrogenation reaction zone 5 via conduit 6 and is contacted with an aqueous scrubbing solution which is introduced via conduit 7. The resulting admixture of the hydrogenated hydrocarbonaceous effluent and the aqueous scrubbing solution is passed via conduit 6 and cooled in heat-exchanger 8. The resulting cooled effluent from heat-exchanger 8 is passed via conduit 6 into high pressure vapor/liquid separator 9. A hydrogen-rich gaseous stream is removed from high pressure vapor/liquid separator 9 via conduit 10, heated to a suitable temperature in heat exchanger 12 and utilized to contact the waste oil feed stream as hereinabove described. Since hydrogen is lost in the process by means of a portion of the hydrogen being dissolved in the exiting liquid hydrocarbon and hydrogen being consumed during the hydrogenation reaction, it is necessary to supplant the hydrogen-rich gaseous stream with make-up hydrogen from some suitable external source, for example, a catalytic reforming unit or a hydrogen plant. Make-up hydrogen may be introduced into the system at any convenient and suitable point, and is introduced in the drawing via conduit 11. A liquid hydrogenated hydrocarbonaceous stream comprising hydrogen in solution is removed from high pressure vapor/liquid separator 9 via conduit 14 and is introduced into low pressure vapor/liquid separator 15. A spent aqueous scrubbing solution is removed from high pressure vapor/liquid separator 9 via conduit 13 and recovered. A gaseous stream comprising hydrogen and any normally gaseous hydrocarbons present is removed from low pressure vapor/liquid separator 15 via conduit 17 and recovered. A normally liquid distillable hydrogenated hydrocarbonaceous product is removed from low pressure vapor/liquid separator 15 via conduit 16 and recovered. In the event that the waste oil feed stream contains water, this water is recovered from high pressure vapor/liquid separator 9 via conduit 13 together with the spent aqueous scrubbing solution as hereinabove described.

The following example is presented for the purpose of further illustrating the process of the present invention, and to indicate the benefits afforded by the utilization thereof in producing a distillable hydrogenated hydrocarbonaceous product while minimizing thermal degradation of the temperature-sensitive hydrocarbonaceous feed stream containing a non-distillable component.

EXAMPLE

A waste oil stream was selected for processing in accordance with the process of the present invention and had the characteristics as presented in Table 1.

TABLE 1

| WASTE OIL ANALYSIS | |
|---|---|
| Specific Gravity @ 60° F. (15° C.) | 0.907 |
| Distillation, °F. (°C.) (D-1160) | |
| IBP | 198 (92) |
| 50% | 741 (394) |
| EP | 957 (514) |
| % Over | 88 |
| % Residue | 12 |
| Emulsified Water, weight percent | 19 |
| Ash, weight percent | 1.15 |
| Metals, weight percent | 0.41 |

The waste oil stream primarily contained used lubricating oil contaminated with emulsified water and trace quantities of heavy metals and is pumped to a primary or first flash zone at a temperature of 560° F. (294° C.) and contacted with hot hydrogen in order to maintain flash zone conditions at a pressure of 850 psig (5861 kPa gauge), a temperature of 710° F. (377° C.) and a hydrogen to oil ratio of about 10,000 standard cubic feet per barrel (SCFB) (1685 normal $m^3/m^3$). The first flash zone produced a hydrocarbonaceous vapor stream comprising hydrogen and water vapor which stream contained about 60 volume percent of the waste oil feedstock and the hydrocarbon fraction of this stream had a specific gravity at 60° F. (15° C.) of 0.867.

The bottoms stream from the first flash zone is introduced to a second flash zone and contacted with hot hydrogen in order to maintain flash zone conditions at a pressure of 50 psig (345 kPa gauge), a temperature of 770° F. (410° C.) and hydrogen to oil ratio of about 10,000 SCFB (1685 normal $m^3/m^3$).

In the second flash zone, about 31 volume of the original waste oil (~78 volume percent of the second flash zone hydrocarbon feed) was vaporized, passed through a guard bed containing hydrogenation catalyst and then condensed. The properties of this resulting distillable hydrocarbon stream are presented in Table 2 along with the properties of all the pertinent streams referred to in this example.

TABLE 2

SUMMARY OF RESULTS

| | Hydrocarbon Stream | | | | | |
|---|---|---|---|---|---|---|
| | 1 | 2 | 3 | 4 | 5 | 6 |
| Description | Waste Oil | Distillable Hydrocarbon | Distillable Hydrocarbon | Hydrocarbon to Hydrogenation | Hydrogenation Zone Product | Non-Distillable |

TABLE 2-continued

| SUMMARY OF RESULTS | Hydrocarbon Stream | | | | | |
|---|---|---|---|---|---|---|
| | 1 | 2 | 3 | 4 | 5 | 6 |
| | | From 1st Flash | From 2nd Flash | | | |
| Specific Gravity 60° F. (15° C.) | 0.9072 | 0.867 | 0.871 | 0.869 | 0.860 | ~1.1 |
| Sulfur, Weight Percent | 0.23 | | | 0.228 | 0.07 | |
| D-1160 Distillation, °F. (°C.) | | | | | | |
| IBP | 198 | 140 | 700 | 142 | 140 | |
| 10 | 216 | | | | | |
| 30 | 651 | | | 644 | | |
| 50 | 741 | 660 | 820 | 729 | 725 | |
| 70 | 806 | | | 790 | | |
| 90 | | | | 865 | | |
| EP | 957 | 780 | 1050 | 1030 | 1030 | |
| % Over | 88 | 99 | 99 | 99 | 99 | |
| % Residue | 12 | 1 | 1 | 1 | 1 | |

The guard bed removed trace levels of entrained metals and finely divided particulate matter from the flashed hydrocarbonaceous stream and was operated at a temperature of about 400° F. (204° C.) and a liquid hourly space velocity of 2. The condensed liquid hydrocarbon from the second flash zone is introduced into a catalytic hydrogenation zone in admixture with the vaporous hydrocarbonaceous stream from the first flash zone. The catalytic hydrogenation zone was operated at a pressure of about 800 psig (5516 kpa gauge) and 600° F. (315° C.) with a hydrogen to feed ratio of ~11,000 SCFB (1854 normal $m^3/m^3$). The hydrogenated hydrocarbonaceous product recovered from the catalytic hydrogenation zone was analyzed and the results are presented in Table 2. Approximately 9 volume percent of the original waste oil left the second flash zone as a non-distillable residue. The majority, 99+% of the sulfated ash present in the original waste oil left the process with the non-distillable residue stream.

The foregoing description, drawing and example clearly illustrate the advantages encompassed by the process of the present invention and the benefits to be afforded with the use thereof.

We claim:

1. A process for treating a hydrocarbonaceous stream containing a non-distillable component to produce a hydrogenated distillable hydrocarbonaceous product and a heavy product comprising said non-distillable component while minimizing thermal degradation of said hydrocarbonaceous stream which process comprises the steps of:

(a) contacting said hydrocarbonaceous stream with a hot first hydrogen-rich gaseous stream having a temperature greater than said hydrocarbonaceous stream in a first flash zone at flash conditions including a first pressure thereby increasing the temperature of said hydrocarbonaceous stream and vaporizing at least a portion thereof to provide a first hydrocarbonaceous vapor stream comprising hydrogen and a first heavy product stream comprising said non-distillable component;

(b) contacting said first heavy product stream comprising said non-distillable component with a hot second hydrogen-rich gaseous stream in a second flash zone at flash conditions including a second pressure which is less than said first pressure of step (a) thereby vaporizing at least a portion thereof to provide a second hydrocarbonaceous vapor stream comprising hydrogen and a second heavy product stream comprising said non-distillable component;

(c) condensing at least a portion of said second hydrocarbonaceous vapor stream to provide a first liquid stream comprising distillable hydrocarbonaceous compounds;

(d) contacting said first hydrocarbonaceous vapor stream comprising hydrogen from step (a) and said first liquid stream comprising distillable hydrocarbonaceous compounds from step (c) with a hydrogenation catalyst in a hydrogenation reaction zone at hydrogenation conditions to increase the hydrogen content of the hydrocarbonaceous compounds introduced into said hydrogenation reaction zone;

(e) condensing at least a portion of the resulting effluent from said hydrogenation reaction zone to provide a third hydrogen-rich gaseous stream and a liquid stream comprising hydrogenated distillable hydrocarbonaceous compounds; and (f) recovering a hydrogenated distillable hydrocarbonaceous product from said liquid stream comprising hydrogenated distillable hydrocarbonaceous compounds.

2. The process of claim 1 wherein said third hydrogen-rich gaseous stream recovered in step (e) is recycled to step (a).

3. The process of claim 1 wherein said hydrocarbonaceous stream comprises dielectric fluids, hydraulic fluids, heat transfer fluids, used lubricating oil, used cutting oils, used solvents, still bottoms from solvent recycle operations, coal tars, atmospheric residuum, PCB-contaminated oils, halogenated wastes or other hydrocarbonaceous industrial waste.

4. The process of claim 1 wherein said non-distillable component comprises organometallic compounds, inorganic metallic compounds, finely divided particulate matter or non-distillable hydrocarbonaceous compounds.

5. The process of claim 1 wherein said hydrocarbonaceous stream is introduced into said flash zone at a temperature less than about 580° F. (304° C.).

6. The process of claim 1 wherein the temperature of said hot first hydrogen-rich stream is from about 200° F. (93° C.) to about 1200° F. (649° C.).

7. The process of claim 1 wherein the temperature of said hot second hydrogen-rich stream is from about 200° F. (93° C.) to about 1200° F. (649° C.).

8. The process of claim 1 wherein said flash conditions include a temperature from about 150° F. (65° C.) to about 860° F. (460° C.), a pressure from about atmospheric to about 2000 psig (13788 kPa gauge), a hydrogen circulation rate of about 1000 SCFB (168 normal $m^3/m^3$) to about 30,000 SCFB (5056 normal $m^3/m^3$) based on said hydrocarbonaceous stream, and an average residence time of said hydrocarbonaceous vapor stream comprising hydrogen in said flash zone from about 0.1 seconds to about 50 seconds.

9. The process of claim 1 wherein said hydrocarbonaceous stream comprises halogenated hydrocarbons or organometallic compounds.

10. The process of claim 1 wherein said hydrogenation reaction zone is operated at conditions which include a pressure from about atmospheric (0 kPa gauge) to about 2000 psig (13,790 kPa gauge), a maximum catalyst temperature from about 122° F. (50° C.) to about 850° F. (454° C.) and a hydrogen circulation rate from about 200 SCFB (33.7 normal $m^3/m^3$) to about 50,000 SCFB (8427 normal $m^3/m^3$).

11. The process of claim 1 wherein said hydrogenation catalyst comprises a refractory inorganic oxide and at least one metallic compound having hydrogenation activity.

12. The process of claim 11 wherein said metallic compound is selected from the metals of Group VIB and VIII of the Periodic Table.

13. The process of claim 1 wherein said second hydrocarbonaceous vapor stream is passed through a guard bed prior to condensing in step (c).

14. A process for treating a hydrocarbonaceous stream containing a non-distillable component to produce a hydrogenated distillable hydrocarbonaceous product and a heavy product comprising said non-distillable component while minimizing thermal degradation of said hydrocarbonaceous stream which process comprises the steps of:

(a) contacting said hydrocarbonaceous stream with a hot first hydrogen-rich gaseous stream having a temperature greater than said hydrocarbonaceous stream in a first flash zone at flash conditions thereby increasing the temperature of said hydrocarbonaceous stream and vaporizing at least a portion thereof to provide a first hydrocarbonaceous vapor stream comprising hydrogen and a first heavy product stream comprising said non-distillable component;

(b) contacting said first heavy product stream comprising said non-distillable component with a hot second hydrogen-rich gaseous stream in a second flash zone at flash conditions including a second pressure which is less than said first pressure of step (a) thereby vaporizing at least a portion thereof to provide a second hydrocarbonaceous vapor stream comprising hydrogen and a second heavy product stream comprising said non-distillable component;

(c) condensing at least a portion of said second hydrocarbonaceous vapor stream to provide a first liquid stream comprising distillable hydrocarbonaceous compounds;

(d) contacting said first hydrocarbonaceous vapor stream comprising hydrogen from step (a) and said first liquid stream comprising distillable hydrocarbonaceous compounds from step (c) with a hydrogenation catalyst in a hydrogenation reaction zone at hydrogenation conditions to increase the hydrogen content of the hydrocarbonaceous compounds introduced into said hydrogenation reaction zone;

(e) condensing at least a portion of the resulting effluent from said hydrogenation reaction zone to provide a third hydrogen-rich gaseous stream and a first liquid stream comprising hydrogenated distillable hydrocarbonaceous compounds; and (f) separating said first liquid stream comprising hydrogenated distillable hydrocarbonaceous compounds to provide a third hydrocarbonaceous vapor stream comprising normally gaseous hydrocarbons and a normally liquid hydrogenated distillable hydrocarbonaceous product.

15. The process of claim 14 wherein said third hydrogen-rich gaseous stream recovered in step (e) is recycled to step (a).

16. The process of claim 14 wherein said hydrocarbonaceous stream comprises dielectric fluids, hydraulic fluids, heat transfer fluids, used lubricating oil, used cutting oils, used solvents, still bottoms from solvent recycle operations, coal tars, atmospheric residuum, PCB-contaminated oils, halogenated wastes or other hydrocarbonaceous industrial waste.

17. The process of claim 14 wherein said non-distillable component comprises organometallic compounds, inorganic metallic compounds, finely divided particulate matter or non-distillable hydrocarbonaceous compounds.

18. The process of claim 14 wherein said hydrocarbonaceous stream is introduced into said flash zone at a temperature less than about 580° F. (304° C.).

19. The process of claim 14 wherein the temperature of said hot first hydrogen-rich stream is from about 200° F. (93° C.) to about 1200° F. (649° C.).

20. The process of claim 14 wherein the temperature of said hot second hydrogen-rich stream is from about 200° F. (93° C.) to about 1200° F. (649° C.).

21. The process of claim 14 wherein said flash conditions include a temperature from about 150° F. (65° C.) to about 860° F. (460° C.), a pressure from about atmospheric to about 2000 psig (13788 kPa gauge), a hydrogen circulation rate of about 1000 SCFB (168 normal $m^3/m^3$) to about 30,000 SCFB (5056 normal $m^3/m^3$) based on said hydrocarbonaceous stream, and an average residence time of said hydrocarbonaceous vapor stream comprising hydrogen in said flash zone from about 0.1 seconds to about 50 seconds.

22. The process of claim 14 wherein said hydrocarbonaceous stream comprises halogenated hydrocarbons or organometallic compounds.

23. The process of claim 14 wherein said hydrogenation reaction zone is operated at conditions which include a pressure from about atmospheric (0 kPa gauge) to about 2000 psig (13790 kPa gauge), a maximum catalyst temperature from about 122° F. (50° C.) to about 850° F. (454° C.) and a hydrogen circulation rate from about 200 SCFB (33.7 normal $m^3/m^3$) to about 50,000 SCFB (8427 normal $m^3/m^3$).

24. The process of claim 15 wherein said hydrogenation catalyst comprises a refractory inorganic oxide and at least one metallic compound having hydrogenation activity.

25. The process of claim 24 wherein said metallic compound is selected from the metals of Group VIB and VIII of the Periodic Table.

26. The process of claim 14 wherein said second hydrocarbonaceous vapor stream is passed through a guard bed prior to condensing in step (c).

27. A process for treating a hydrocarbonaceous stream containing a non-distillable component to produce a hydrogenated distillable hydrocarbonaceous product and a heavy product comprising said non-distillable component while minimizing thermal degradation of said hydrocarbonaceous stream which process comprises the steps of:

(a) contacting said hydrocarbonaceous stream with a hot first hydrogen-rich gaseous stream having a temperature greater than said hydrocarbonaceous stream in a first flash zone at flash conditions including a first pressure thereby increasing the temperature of said hydrocarbonaceous stream and vaporizing at least a portion thereof to provide a first hydrocarbonaceous vapor stream comprising hydrogen and a first heavy product stream comprising said non-distillable component;

(b) contacting said first heavy product stream comprising said non-distillable component with a hot second hydrogen-rich gaseous stream in a second flash zone at flash conditions including a second pressure which is less than said first pressure of step (a) thereby vaporizing at least a portion thereof to provide a second hydrocarbonaceous vapor stream comprising hydrogen and a second heavy product stream comprising said non-distillable component;

(c) condensing at least a portion of said second hydrocarbonaceous vapor stream to provide a first liquid stream comprising distillable hydrocarbonaceous compounds;

(d) contacting said first hydrocarbonaceous vapor stream comprising hydrogen from step (a) and said first liquid stream comprising distillable hydrocarbonaceous compounds from step (c) with a hydrogenation catalyst in a hydrogenation zone at hydrogenation conditions to simultaneously increase the hydrogen content of the hydrocarbonaceous compounds introduced into said hydrogenation reaction zone and to generate at least one water-soluble inorganic compound produced from the reaction of the hydrocarbonaceous compounds introduced into said hydrogenation reaction zone and said hydrogen;

(e) contacting the resulting effluent from said hydrogenation zone containing hydrogenated hydrocarbonaceous compounds and at least one water-soluble inorganic compound with a fresh aqueous scrubbing solution;

(f) introducing a resulting admixture of said effluent from said hydrogenation zone and said aqueous scrubbing solution into a separation zone to provide a third hydrogen-rich gaseous stream, a first liquid stream comprising hydrogenated distillable hydrocarbonaceous compounds and a spent aqueous scrubbing solution containing at least a portion of said water-soluble inorganic compound; and (g) separating said first liquid stream comprising hydrogenated distillable hydrocarbonaceous compounds to provide a third hydrocarbonaceous vapor stream comprising normally gaseous hydrocarbons and a normally liquid hydrogenated distillable hydrocarbonaceous product.

28. The process of claim 27 wherein said third hydrogen-rich gaseous stream recovered in step (f) is recycled to step (a).

29. The process of claim 27 wherein said hydrocarbonaceous stream comprises dielectric fluids, hydraulic fluids, heat transfer fluids, used lubricating oil, used cutting oils, used solvents, still bottoms from solvent recycle operations, coal tars, atmospheric residuum, PCB-contaminated oils, halogenated wastes or other hydrocarbonaceous industrial waste.

30. The process of claim 27 wherein said non-distillable component comprises organometallic compounds, inorganic metallic compounds, finely divided particulate matter or non-distillable hydrocarbonaceous compounds.

31. The process of claim 27 wherein said hydrocarbonaceous stream is introduced into said flash zone at a temperature less than about 580° F. (304° C.).

32. The process of claim 27 wherein the temperature of said hot first hydrogen-rich stream is from about 200° F. (93° C.) to about 1200° F. (649° C.).

33. The process of claim 27 wherein the temperature of said hot second hydrogen-rich stream is from about 200° F. (93° C.) to about 1200° F. (649° C.).

34. The process of claim 27 wherein said flash conditions include a temperature from about 150° F. (65° C.) to about 860° F. (460° C.), a pressure from about atmospheric to about 2000 psig (13788 kPa gauge), a hydrogen circulation rate of about 1000 SCFB (168 normal $m^3/m^3$) to about 30,000 SCFB (5056 normal $m^3/m^3$) based on said hydrocarbonaceous stream, and an average residence time of said hydrocarbonaceous vapor stream comprising hydrogen in said flash zone from about 0.1 seconds to about 50 seconds.

35. The process of claim 27 wherein said hydrocarbonaceous stream comprises halogenated hydrocarbons or organometallic compounds.

36. The process of claim 27 wherein said hydrogenation reaction zone is operated at conditions which include a pressure from about atmospheric (0 kPa gauge) to about 2000 psig (13790 kPa gauge), a maximum catalyst temperature from about 122° F. (50° C.) to about 850° F. (454° C.) and a hydrogen circulation rate from about 200 SCFB (33.7 normal $m^3/m^3$) to about 50,000 SCFB (8427 normal $m^3/m^3$).

37. The process of claim 27 wherein said hydrogenation catalyst comprises a refractory inorganic oxide and at least one metallic compound having hydrogenation activity.

38. The process of claim 37 wherein said metallic compound is selected from the metals of Group VIB or VIII of the Periodic Table.

39. The process of claim 27 wherein said water-soluble inorganic compound is selected from the group consisting of hydrogen sulfide, ammonia, hydrogen chloride, hydrogen bromide and hydrogen fluoride.

40. The process of claim 27 wherein said aqueous scrubbing solution comprises a compound selected from the group consisting of calcium hydroxide, potassium hydroxide and sodium hydroxide.

41. The process of claim 27 wherein said second hydrocarbonaceous vapor stream is passed through a guard bed prior to condensing in step (c).

* * * * *